US011326222B2

(12) United States Patent
Jang et al.

(10) Patent No.: US 11,326,222 B2
(45) Date of Patent: May 10, 2022

(54) AUSTENITIC STAINLESS STEEL CONTAINING NIOBIUM AND MANUFACTURING METHOD OF THE SAME

(71) Applicant: KOREA ADVANCED INSTITUTE OF SCIENCE AND TECHNOLOGY, Daejeon (KR)

(72) Inventors: Chang-Heui Jang, Daejeon (KR); Ji Ho Shin, Daejeon (KR); Byeong Seo Kong, Daejeon (KR); Ho-Sub Kim, Daejeon (KR); Hyeon Bae Lee, Daejeon (KR)

(73) Assignee: KOREA ADVANCED INSTITUTE OF SCIENCE AND TECHNOLOGY, Daejeon (KR)

( * ) Notice: Subject to any disclaimer, the term of this patent is extended or adjusted under 35 U.S.C. 154(b) by 0 days.

(21) Appl. No.: 16/476,597

(22) PCT Filed: Nov. 28, 2018

(86) PCT No.: PCT/KR2018/014845
§ 371 (c)(1),
(2) Date: Jul. 9, 2019

(87) PCT Pub. No.: WO2020/101101
PCT Pub. Date: May 22, 2020

(65) Prior Publication Data

US 2021/0348248 A1 Nov. 11, 2021

(30) Foreign Application Priority Data

Nov. 13, 2018 (KR) ..... 10-2018-0138927

(51) Int. Cl.

| | |
|---|---|
| ***C21D 9/46*** | (2006.01) |
| ***C21D 6/00*** | (2006.01) |
| ***C21D 6/02*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/48*** | (2006.01) |
| ***C22C 38/50*** | (2006.01) |

(52) U.S. Cl.
CPC ..... *C21D 9/46* (2013.01); *C21D 6/004* (2013.01); *C21D 6/005* (2013.01); *C21D 6/008* (2013.01); *C21D 6/02* (2013.01); *C21D 8/0205* (2013.01); *C21D 8/0226* (2013.01); *C22C 38/001* (2013.01); *C22C 38/002* (2013.01); *C22C 38/02* (2013.01); *C22C 38/04* (2013.01); *C22C 38/48* (2013.01); *C22C 38/50* (2013.01); *C21D 2211/001* (2013.01); *C21D 2211/004* (2013.01)

(58) Field of Classification Search
CPC ..... C21D 2211/001; C21D 2211/004; C21D 6/004; C21D 6/005; C21D 6/008; C21D 6/02; C21D 8/0205; C21D 8/0226; C21D 9/46; C21D 38/001; C21D 38/002; C21D 38/02; C21D 38/04; C21D 38/48; C21D 38/50
See application file for complete search history.

(56) References Cited

FOREIGN PATENT DOCUMENTS

| | | |
|---|---|---|
| JP | 3764586 | 4/2006 |
| JP | 4519505 | 8/2010 |
| JP | 2014-009372 | 1/2014 |
| JP | 6383503 | 8/2018 |
| KR | 10-2002-0047572 | 6/2002 |
| KR | 100570894 B1 * | 4/2006 |
| KR | 10-2012-0011341 | 2/2012 |
| KR | 10-1401625 | 6/2014 |
| KR | 10-1697093 | 1/2017 |
| KR | 10-2017-0074265 | 6/2017 |

OTHER PUBLICATIONS

Creep behavior and microstructure evolution at 750 1C in a new precipitation-strengthened heat-resistant austenitic stainless steel Vu The Ha, Woo Sang Jung Material Science and Engineering p. 103-111 (Year: 2012).*

Ji Ho Shin et al., "Development and radiation characteristic evaluation of Advanced Radiation Resistant Austenitic Alloys (AR2A2) for reactor internals", Transactions of the Korean Nuclear Society Spring Meeting, May 17, 2018.

Ji Ho Shin et al., "Development of Austenitic Stainless Steels with Uniform Dispersion of Nano-size Carbides", Nuclear & High Temperature Materials Laboratory Department of Nuclear & Quantum Engineering, KAIST, Oct. 24, 2018.

KIPO, PCT Search Report & Written Opinion of PCT/KR2018/014845 dated Aug. 2, 2019.

Caryn Nicole Homsher, "Determination of the Non-Recrystallization Temperature (TNR) in Multiple Microalloyed Steels", Colorado School of Mines, 2013.

Ji Ho Shin et al., "Development and radiation characteristic evaluation of Advanced Radiation Resistant Austenitic Alloys (AR2A2) for reactor internals", Transactions of the Korean Nuclear Society Spring Meeting, Jeju, Republic of Korea, May 17, 2018.

Ji Ho Shin et al., "Development of Austenitic Stainless Steels with Uniform Dispersion of Nano-size Carbides", 6th Korea-Japan Joint workshop on Nuclear Materials-Materials Development for Advanced Nuclear Systems, Oct. 24, 2018.

* cited by examiner

*Primary Examiner* — Jenny R Wu
(74) *Attorney, Agent, or Firm* — Lex IP Meister, PLLC

(57) ABSTRACT

The austenitic stainless steel containing niobium according to an exemplary embodiment of the present invention includes: 16 to 26 wt. % of chromium (Cr), 8 to 22 wt. % of nickel (Ni), 0.02 to 0.1 wt. % of carbon (C), 0.2 to 1 wt. % of niobium (Nb), 0.015 to 0.025 wt. % of titanium (Ti), 0.004 to 0.01 wt. % of nitrogen (N), and 0.5 to 2 wt. % of manganese (Mn), wherein the austenitic stainless steel containing niobium has an austenitic matrix structure, a fine niobium carbide and a fine titanium nitride are precipitated in the austenitic matrix structure, and the fine niobium carbide is uniformly dispersed in the austenitic matrix structure.

5 Claims, 10 Drawing Sheets

AUSTENITIC STAINLESS STEEL CONTAINING NIOBIUM AND MANUFACTURING METHOD OF THE SAME

TECHNICAL FIELD

The present invention relates to an austenitic stainless steel containing niobium and a manufacturing method thereof.

BACKGROUND ART

In general, fine-scale precipitates present in an austenitic stainless steel matrix may play a very important role, such as stabilizing a microstructure and inhibiting grains growth and recrystallization.

Here, a process of forming the precipitates in a matrix generally includes a quenching and stabilizing heat treatment process performed following a solution treatment through a high temperature heat treatment and, a diffusion reaction process using nitriding and carburizing techniques, mechanical alloying process, and the like.

However, when these general processes are applied to an austenitic stainless steel to form fine-scale precipitates, an excessively long time may be required and an expensive processing method must be used, and thus high manufacturing costs may be required. In particular, currently used processes have limitations in forming a uniformly distributed, several nano-sized precipitates with high density in the matrix.

Thus, in order to form nano-sized fine-scale precipitates in an austenitic stainless steel matrix, elements forming the precipitates as well as the process to be applied may play an important role. This is because nucleation free energy, interface energy, activation energy barrier being affected by mismatch, and the like has an effect on the micronization of the precipitates. As elements excellent in forming the fine-scale precipitates ability, for example, vanadium (V), niobium (Nb), titanium (Ti), tantalum (Ta), hafnium (Hf), and the like are known, and among these elements, steel types containing niobium may be defined as an austenitic stainless steel containing niobium.

A general austenitic stainless steel containing niobium may be manufactured by performing hot rolling on a slab to produce a hot rolled steel sheet, and then sequentially subjecting the hot rolled steel sheet to a solid solution heat treatment and a stabilizing heat treatment. Here, the solid solution heat treatment may be performed for the purpose of securing mechanical properties from softening of the hot rolled structure by recrystallization and restoring corrosion resistance by re-solid solution treatment of precipitated chromium carbide ($Cr_{23}C_6$), and may be preformed at a high temperature of about 920 to 1150° C. In addition, the stabilizing heat treatment may be performed at about 850 to 930° C. for a relatively long time (about 1 to 2 hours per 25 mm plate thickness) to stabilize carbon through precipitation of niobium carbide (NbC) by niobium, which is a stabilizing element.

However, sizes of niobium carbide contained in such general austenitic stainless steel containing niobium may be relatively coarse and non-uniform, and the niobium carbide may be distributed non-uniformly within grains.

DISCLOSURE

Technical Problem

The present invention has been made in an effort to provide an austenitic stainless steel containing niobium and a manufacturing method thereof having advantages of uniformly distributing nano-sized fine niobium carbide in the austenitic stainless steel, within a matrix.

Further, the present invention has been made in an effort to provide an austenitic stainless steel containing niobium and a manufacturing method thereof having advantages of improving mechanical properties such as strength of the austenitic stainless steel.

Further, the present invention has been made in an effort to provide an austenitic stainless steel containing niobium and a manufacturing method thereof having advantages of improving irradiation resistance of the austenitic stainless steel against neutrons.

Further, the present invention has been made in an effort to provide an austenitic stainless steel containing niobium and a manufacturing method thereof having advantages of improving weldability of the austenitic stainless steel.

Further, the present invention has been made in an effort to provide an austenitic stainless steel containing niobium and a manufacturing method thereof having advantages of reducing manufacturing costs of the austenitic stainless steel.

Further, the present invention has been made in an effort to provide an austenitic stainless steel containing niobium and a manufacturing method thereof having advantages of improving productivity of the austenitic stainless steel.

Exemplary embodiments according to the present invention may be used to achieve other objects not specifically mentioned, in addition to the objects above.

Technical Solution

An exemplary embodiment of the present invention provides an austenitic stainless steel containing niobium including 16 to 26 wt. % of chromium (Cr), 8 to 22 wt. % of nickel (Ni), 0.02 to 0.1 wt. % of carbon (C), 0.2 to 1 wt. % of niobium (Nb), 0.015 to 0.025 wt. % of titanium (Ti), 0.004 to 0.01 wt. % of nitrogen (N), and 0.5 to 2 wt. % of manganese (Mn).

Here, the austenitic stainless steel containing niobium has an austenitic matrix structure, a fine niobium carbide and a fine titanium nitride are precipitated in the austenitic matrix structure, and the fine niobium carbide is uniformly dispersed in the austenitic matrix structure.

An average size of a fine niobium carbide may be 11 nm or less.

The austenitic stainless steel containing niobium may include 0.018 to 0.022 wt. % of titanium and 0.005 to 0.008 wt. % of nitrogen.

The number density of fine niobium carbide may be $10^{14}$ to $10^{15}$ #/m$^2$ in the austenitic matrix structure.

The density of fine niobium carbide may be $5\times10^{21}$ to $5\times10^{22}$ #/m$^3$ in the austenitic matrix structure.

The austenitic stainless steel containing niobium may further include 0.5 wt. % or less of silicon (Si), 0.02 wt. % or less of phosphorus (P), and 0.01 wt. % or less of sulfur (S).

Another embodiment of the present invention provides a manufacturing method of an austenitic stainless steel containing niobium including a melting and casting step of melting mixed steel material and casting the melted mixed steel material to form cast steel material having an austenitic matrix structure, the mixed steel material including 16 to 26 wt. % of chromium (Cr), 8 to 22 wt. % of nickel (Ni), 0.02 to 0.1 wt. % of carbon (C), 0.2 to 1 wt. % of niobium (Nb), 0.015 to 0.025 wt. % of titanium (Ti), 0.004 to 0.01 wt. % of nitrogen (N), and 0.5 to 2 wt. % of manganese (Mn); a step of deriving a non-recrystallization temperature by evaluating a high temperature deformation behavior of the cast steel material; a step of performing a homogenizing heat treatment on the cast steel material; a multi-pass hot rolling step of performing at least 1-pass hot rolling on the cast steel material at a temperature higher than the non-recrystallization temperature, and then performing at least 1-pass hot rolling on the cast steel material at a temperature lower than the non-recrystallization temperature; and a step of precipitating fine niobium carbide in the austenitic matrix structure by performing a heat treatment on the hot-rolled cast steel material, and then air-quenching the hot-rolled cast steel material.

Here, the fine niobium carbide is uniformly dispersed within the austenitic matrix structure.

In the multi-pass hot rolling step, 5- to 8-pass hot rolling may be performed.

3- to 5-pass hot rolling may be performed at a temperature higher than the non-recrystallization temperature, and then 2- to 3-pass hot rolling may be performed at a temperature lower than the non-recrystallization temperature.

A running temperature of each pass may be lowered by 20 to 30° C. while each pass of hot rolling is sequentially performed.

In the melting and casting step, a fine titanium nitride (TiN) may be precipitated in the austenitic matrix structure.

In the step of deriving the non-recrystallization temperature, high temperature deformation behavior of the cast steel material may be evaluated by a hot torsion test or a dynamic property test.

Advantageous Effects

An austenitic stainless steel containing niobium and a manufacturing method thereof according to an embodiment may uniformly distribute nano-sized fine niobium carbide in the austenitic stainless steel, within the matrix, improve mechanical properties such as the strength of the austenitic stainless steel, improve irradiation resistance against neutrons, improve weldability of the austenitic stainless steel, reduce manufacturing costs of the austenitic stainless steel, and improve productivity of the austenitic stainless steel.

MODE FOR INVENTION

Figure 1:
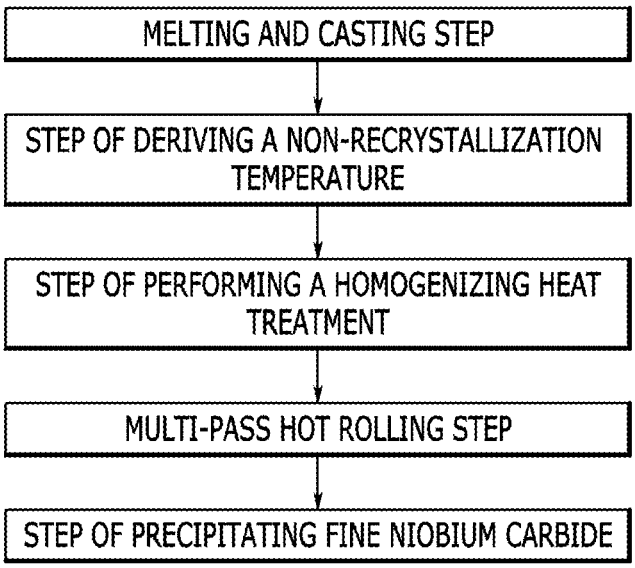
FIG. 1 is a flow chart showing a manufacturing method of an austenitic stainless steel containing niobium according to an embodiment.

Embodiments of the present invention will be described in detail so as to be easily carried out by a person skilled in the art to which the present invention pertains, referring to an accompanying drawing. The present invention may be implemented in various different forms and is not limited to exemplary embodiments described herein. In the drawings, for clearly describing the present invention, parts unrelated to the description will be omitted, and the same reference numeral indicates the same or like constituent element throughout the specification. In addition, the detailed description of well-known techniques will be omitted.

In the drawings, the thickness of layers, films, panels, regions, etc., are exaggerated for clarity. It will be understood that when an element such as a layer, a film, a region, or a substrate is referred to as being "on" another element, it can be directly on the other element or intervening elements may also be present. On the other hand, it will be understood that when any element is referred to as being "directly on" another element, there are no intervening elements present. In contrast, it will be understood that when an element such as a layer, a film, a region, or a substrate is referred to as being "under" another element, it can be directly under the other element or intervening elements may also be present. On the other hand, it will be understood that when any element is referred to as being "directly under" another element, there are no intervening elements present.

Throughout the present specification, unless explicitly described to the contrary, the word "comprising" any elements will be understood to imply the inclusion of stated elements but not the exclusion of any other elements.

An austenitic stainless steel containing niobium according to the embodiments includes about 16 to 26 wt. % of chromium (Cr), about 8 to 22 wt. % of nickel (Ni), about 0.02 to 0.1 wt. % of carbon (C), about 0.2 to 1 wt. % of niobium (Nb), about 0.015 to 0.025 wt. % of titanium (Ti), about 0.004 to 0.01 wt. % of nitrogen (N), about 0.5 to 2 wt. % of manganese (Mn), about 0.5 wt. % or less of silicon (Si), about 0.02 wt. % or less of phosphorus (P), about 0.01 wt. % or less of sulfur (S), a remaining iron (Fe) and unavoidable impurities, and has an austenitic matrix structure.

The austenitic stainless steel containing niobium includes 16 to 26 wt. % of chromium (Cr).

Chromium is a ferrite stabilizing element, and an essential element in stainless steel material used in high-temperature/high-pressure environments in which oxidation resistance, corrosion resistance and creep strength need to be excellent at the same time.

When a content of chromium in the austenitic stainless steel containing niobium is less than about 16 wt. %, oxidation resistance and corrosion resistance of the stainless steel may be deteriorated. When the content of chromium in the austenitic stainless steel containing niobium exceeds about 26 wt. %, a delta ferrite structure is formed to form an abnormal structure together with the austenitic structure, whereby the strength and toughness of the stainless steel may be degraded.

The austenitic stainless steel containing niobium includes 8 to 22 wt. % of nickel (Ni).

Nickel may improve corrosion resistance of the austenitic stainless steel in a non-oxidizing atmosphere. In order for the austenitic stainless steel to have a stable single crystal structure, a content of nickel may be determined through thermodynamic calculations depending on the contents of chromium, iron and nickel. For example, nickel may be adjusted in the range of about 8 to 22 wt. %.

The austenitic stainless steel containing niobium includes about 0.02 to 0.1 wt. % of carbon (C).

Carbon is an austenite stabilizing element, and is supersaturated in the stainless steel and combined with elements such as chromium, niobium, and titanium during a quenching process or a heat treatment process to produce precipitates, thereby improving the strength of the stainless steel. In addition, carbon may improve properties such as room temperature strength, high temperature strength, weldability and moldability of the stainless steel. When a content of carbon in the austenitic stainless steel is less than about 0.02 wt. %, the mechanical strength of the stainless steel at room temperature may be deteriorated.

When the content of carbon in the austenitic stainless steel exceeds about 0.1 wt. %, weldability and moldability of the stainless steel may be deteriorated and toughness of the stainless steel may be deteriorated.

The austenitic stainless steel containing niobium includes about 0.2 to 1 wt. % of niobium (Nb).

The niobium element may combine with the above-mentioned carbon to form nano-sized fine niobium carbide (NbC), and the fine niobium carbide may be uniformly dispersed in the austenite matrix structure.

The fine niobium carbide uniformly dispersed in the austenitic matrix structure may remarkably improve the mechanical properties such as the strength of the stainless steel, improve neutron irradiation resistance, and improve weldability.

When a content of niobium in the austenitic stainless steel is less than about 0.2 wt. %, the amount of niobium carbide to be precipitated is small, so that the degree of improvement in mechanical properties and irradiation resistance of the stainless steel may be insignificant. When the content of niobium in the austenitic stainless steel exceeds about 1 wt. %, niobium carbide with coarse particle size is formed, thereby deteriorating the strength and toughness of the stainless steel.

An average size of fine niobium carbide may be about 11 nm or less. In addition, in the austenitic matrix structure, the number density of fine niobium carbide may be about $10^{14}$ to $10^{15}$ #/m$^2$, and the density of fine niobium carbide may be about $5\times10^{21}$ to $5\times10^{22}$ #/m$^3$. Within these ranges, the mechanical properties, neutron irradiation resistance and weldability of the stainless steel may be further improved.

The austenitic stainless steel containing niobium includes about 0.015 to 0.025 wt. % of titanium (Ti) and about 0.004 to 0.01 wt. % of nitrogen (N).

Titanium is an element having relatively large tendency to combine with nitrogen to produce nitride, and may be combined with nitrogen dissolved in the matrix to form nano-sized fine titanium nitride (TiN). The fine titanium nitride may be dispersed in the austenite matrix structure. In addition, titanium also may combine with nitrogen and carbon to form titanium carbonitride.

Fine titanium nitride may serve to stabilize the matrix in the initial casting step of the alloy and the homogenizing step, which will be described below in connection with the manufacturing method, thereby creating an environment in which fine niobium carbide may form a more homogeneous fine structure.

When a content of titanium in the austenitic stainless steel exceeds about 0.025 wt. %, coarse nitride or carbonitride is formed at a temperature higher than a melting temperature of the matrix, resulting in loss of consistency with the matrix, thereby deteriorating toughness of the stainless steel. When the content of titanium in the austenitic stainless steel is less than about 0.015 wt. %, the stability of the matrix in the casting and homogenizing step may be reduced.

The amount of nitrogen may correspond to that of titanium. Ti/N, which is the ratio of the content of titanium and nitrogen, may be stoichiometrically controlled to be less than 3.42 to ensure that all Tis form nanometer-sized TiN (precipitates). When Ti/N exceeds 3.42 (when the content of nitrogen of the stainless steel is less than 0.004%), coarse titanium nitride may be formed in the matrix, thereby deteriorating the toughness, and causing cracking of the stainless steel. On the other hand, when Ti/N is 3.42 or less and the content of nitrogen in the austenitic stainless steel is about 0.004 to 0.01 wt. %, the austenite granules may be purified in the initial step of manufacturing the austenitic stainless steel.

More preferably, the stainless steel may include about 0.018 to 0.022 wt. % of titanium, about 0.005 to 0.008 wt. % of nitrogen. Within these ranges, the matrix may be more stabilized and more homogeneously and uniformly distributed niobium carbide may be precipitated.

The austenitic stainless steel containing niobium includes about 0.5 to 2 wt. % of manganese (Mn).

Manganese may stabilize the austenitic matrix structure and has solid solution strengthening performance.

When the content of manganese in the austenitic stainless steel is less than about 0.5 wt. %, the strength of the stainless steel may be lowered. When the content of manganese in the austenitic stainless steel exceeds about 2 wt. %, the weldability of the stainless steel may be deteriorated.

The austenitic stainless steel containing niobium includes about 0.5 wt. % or less of silicon (Si).

Silicon may perform a deoxidation function and increase the precipitation amount of carbide. However, since silicon may coagulate precipitates to coarsen, the content of silicon in the austenitic stainless steel may be equal to or less than about 0.5 wt. %, for micronization of the precipitates.

The austenitic stainless steel containing niobium includes about 0.2 wt. % or less of phosphorus (P) and about 0.01 wt. % of less of sulfur (S).

Phosphorus and sulfur are unavoidable impurities present in the stainless steel. When phosphorus and sulfur are contained in large amounts, they tend to segregate in a gain boundary, thereby causing grain boundary embrittlement, which may deteriorate properties such as toughness. Therefore, the content of phosphorus and sulfur may be limited to about 0.02 wt. % or less and about 0.01 wt. % or less, respectively.

Hereinafter, a manufacturing method of an austenitic stainless steel containing niobium according to the embodiments will be described with reference to the drawings.

The constituent elements and the content of the stainless steel were described above, and thus may be omitted in the following.

Figure 2:
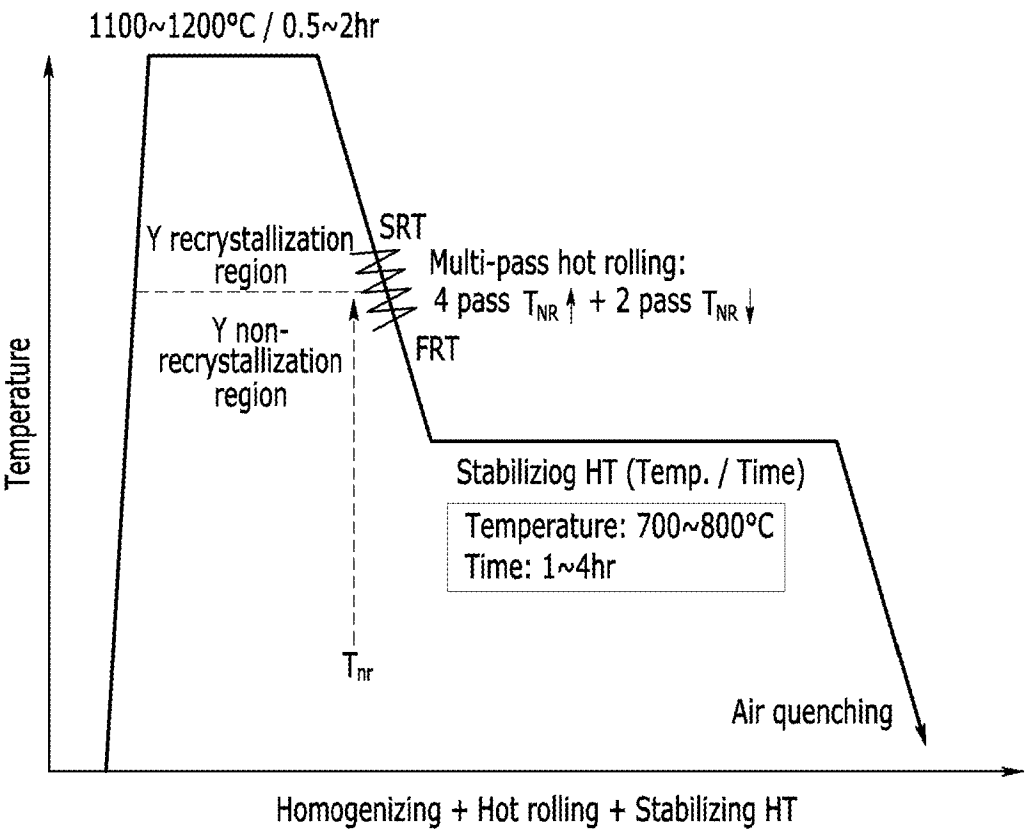
FIG. 2 is a schematic view showing a manufacturing process and condition of an austenitic stainless steel containing niobium according to an embodiment.

FIG. 1 is a flow chart showing a manufacturing method of an austenitic stainless steel containing niobium according to an embodiment. FIG. 2 is a schematic view showing a manufacturing process and conditions of an austenitic stainless steel containing niobium according to an embodiment.

Referring to FIGS. 1 and 2, a manufacturing method of an austenitic stainless steel containing niobium includes a melting and casting step, a step of deriving a non-recrystallization temperature, a step of performing a homogenizing heat treatment, a multi-pass hot rolling step, and a step of precipitating fine niobium carbide.

First, a melting and casting step is performed.

In the melting and casting step, mixed steel material is melted and the melted mixed steel material is cast to form cast steel material having an austenitic base structure, the mixed steel material including 16 to 26 wt. % of chromium (Cr), 8 to 22 wt. % of nickel (Ni), 0.02 to 0.1 wt. % of carbon (C), 0.2 to 1 wt. % of niobium (Nb), 0.015 to 0.025 wt. % of titanium (Ti), 0.004 to 0.01 wt. % of nitrogen (N), 0.5 to 2 wt. % of manganese (Mn), 0.5 wt. % or less of silicon (Si), 0.02 wt. % or less of phosphorus (P), 0.01 wt. % or less of sulfur (S), a remaining iron (Fe) and unavoidable impurities.

Here, the melting process may be a known process, and for example, a vacuum induction melting process may be applied. The casting process may also be a known process, and the cast steel material may be cast, for example, in the form of an ingot.

In the melting and casting step, an austenitic matrix structure may be formed, and at this step, fine titanium nitride (TiN) may be precipitated in the austenitic matrix structure. The fine titanium nitride may stabilize the matrix in the casting step and a homogenizing step, which will be described below, thereby creating an environment in which fine niobium carbide may form a more homogeneous fine structure.

Next, a step of deriving a non-recrystallization temperature ($T_{NR}$) is performed by evaluating high temperature deformation behavior of the cast steel material formed in the melting and casting step.

High temperature deformation behavior of the cast steel material may be evaluated by a hot torsion test or a dynamic physical property test. For example, in order to evaluate high temperature deformation behavior of the cast steel material, a Gleeble dynamic physical property tester may be used and the Gleeble compression test may be used to derive a non-recrystallization temperature. A Gleeble compression test method is disclosed in a known article (for example, C. N. Homsher, "Determination of the Non-Recrystallization Temperature ($T_{NR}$) in Multiple Microalloyed Steels," Colorado School of Mines, 2012.).

Then, a step of performing a homogenizing heat treatment is performed.

By performing the homogenizing heat treatment, a dendrite and unintended carbonitride of the cast steel material may be melted, and a subsequent multi-pass hot rolling process may be effectively performed, whereby fine-scale precipitates may be finely and homogeneously distributed in the matrix in a fine niobium carbide precipitation process.

In this step, the cast steel material may be subject to homogenizing heat treatment at a temperature range of about 1100 to 1200° C. for about 30 minutes to 2 hours.

When the heat treatment is performed at a temperature of less than about 1100° C., re-melting of dendrite and carbonitride is not sufficiently conducted, which may be disadvantageous to homogenization of the alloy element. When the heat treatment is performed at a temperature exceeding about 1200° C., production cost is increased and the effect of refining grains due to titanium nitride may become insignificant, whereby the austenite grains may be coarse, which may weaken the strength and toughness.

When the heat treatment is performed for less than about 30 minutes, re-melting of dendrite and carbonitride is not sufficiently conducted, and solute atoms may be poorly diffused. When the heat treatment time exceeds about 2 hours, grains may be coarse and the production cost may be increased.

Within the temperature range and the time rage of the homogenizing heat treatment described above, when the heat treatment temperature is increased, correspondingly, the heat treatment time may be shortened.

Then, the homogenizing heat treated cast steel material may be quenched in air, and a multi-pass hot rolling step may be performed at a designed hot rolling start temperature.

The multi-pass hot rolling step is a step of performing at least 1-pass hot rolling at a temperature higher than the non-recrystallization temperature, and then performing at least 1-pass hot rolling at a temperature lower than the non-recrystallization temperature, based on the derived non-recrystallization temperature as described above. Here, the multi-pass hot rolling may be referred to as being performed stepwise by dividing hot rolling into a plurality of sections, and each section may be defined as a pass.

For example, a total of 5- to 8-pass hot rolling may be performed. Specifically, 3- to 5-pass hot rolling may be performed at a temperature higher than the non-recrystallization temperature, and then 2- to 3-pass hot rolling may be performed at a temperature lower than the non-recrystallization temperature.

In a process of manufacturing a conventional austenitic stainless steel containing niobium, the hot rolling process is performed at a temperature higher than the non-recrystallization temperature.

On the other hand, in the case of a method of manufacturing the austenitic stainless steel containing niobium according to the embodiments, the hot rolling is performed even at a temperature higher than the non-recrystallization temperature, and the hot rolling is performed even at a temperature lower than the non-recrystallization temperature.

The running temperature of each pass may be different by about 20 to 30° C. For example, when the hot rolling is performed by a plurality of passes, the running temperature of each pass may be lowered by 20 to 30° C. while each pass of hot rolling is sequentially performed. Specifically, when 5-pass hot rolling is performed, the first-pass hot rolling may be performed at the hot rolling starting temperature which is relatively highest and higher than the non-recrystallization temperature, the second pass hot rolling may be performed at a temperature about 20 to 30° C. lower than the first pass hot rolling temperature, the third pass hot rolling may be performed at a temperature about 20 to 30° C. lower than the second pass hot rolling temperature, the fourth-pass hot rolling may be performed at a temperature about 20 to 30° C. lower than the third pass hot rolling temperature and lower than the non-recrystallization temperature, and the fifth-pass hot rolling may be performed at the hot rolling end temperature about 20 to 30° C. lower than that of the fourth-pass hot rolling.

FIG. 2 shows a multi-pass hot rolling step in which 4-pass hot rolling is performed at a temperature higher than the non-recrystallization temperature and 2-pass hot rolling is performed at a temperature lower than the non-recrystallization temperature.

By this stepwise multi-pass hot rolling, the dislocation in the matrix may be appropriately distributed, and correspondingly, the fine niobium carbide may be more finely and uniformly dispersed.

A reduction ratio of the cast steel material by performing the multi-pass hot rolling step may be designed as required, and thus the thickness may be adjusted.

Next, a step of precipitating fine niobium carbide (NbC) in the austenitic matrix structure is performed.

This step is a step of performing a stabilizing heat treatment on the steel material subjected to the multi-pass hot rolling step at a temperature of about 700 to 800° C. for about 1 to 4 hours, and then air-quenching the steel material.

In this process, nano-sized fine niobium carbide is precipitated, and the fine niobium carbide is uniformly distributed in the matrix.

When a stabilizing heat treatment temperature is less than about 700° C., the precipitation amount of niobium carbide may be excessively small. In addition, when the stabilizing heat treatment temperature exceeds about 800° C., a cell structure is formed due to a shift of dislocation in the matrix. At this time, niobium carbide is not uniformly distributed in the matrix and is precipitated along the boundary of the cell structure, thereby weakened toughness of the stainless steel and causing cracking.

In the conventional method of manufacturing stainless steel containing niobium carbide, the stabilizing heat treatment is performed at a relatively high temperature of about 900° C. or more, whereby coarsening of precipitates and heterogeneous distribution may occur. However, according to the method of manufacturing the stainless steel according to the embodiments, the stabilizing heat treatment is performed at about 700 to 800° C., which is a proper temperature at which niobium carbide is formed, whereby the nano-sized fine niobium carbide may be homogeneously/uniformly precipitated and distributed in the austenitic matrix structure.

When the stabilizing heat treatment time is less than about 1 hour, the precipitation amount of niobium carbide may be excessively small. When the stabilizing heat treatment time exceeds about 4 hours, niobium carbide may be coarse and $M_{23}C_6$ carbide formed in the niobium depleted region may reduce the corrosion resistance of stainless steel. Here, M may include elements such as chromium or iron.

Following the stabilizing heat treatment, an austenitic stainless steel containing fine niobium carbide may be manufactured by quenching the steel material with an air quenching method instead of a water quenching or quenching method so as to form fine niobium carbide nucleus in the matrix by utilizing the difference in solubility of elements in the matrix depending on the temperature.

Hereinafter, the present invention will be described in more detail with reference to Examples. However, the following Examples are merely examples of the present invention, and the present invention is not limited to the following Examples.

Example 1

1) Casting

Mixed steel material having compositional components described in Table 1 below was melted/cast using a vacuum induction melting furnace to form a cast ingot.

Table 1 below shows the chemical composition values measured by ICP-AES analytical method, and the unit of each numerical value is % by weight.

TABLE 1

| | Fe | Cr | Ni | C | Mn | Si | Nb | Ti | N |
|---|---|---|---|---|---|---|---|---|---|
| Example1 | Bal. | 24.13 | 21.07 | 0.042 | 1.32 | 0.23 | 0.27 | 0.023 | 0.008 |

2) Non-Recrystallization Temperature ($T_{NR}$) Setting

In order to evaluate a high temperature deformation behavior, a Gleeble dynamic physical property tester (Gleeble 3800), a high temperature compression tester, was used.

Figure 3A:
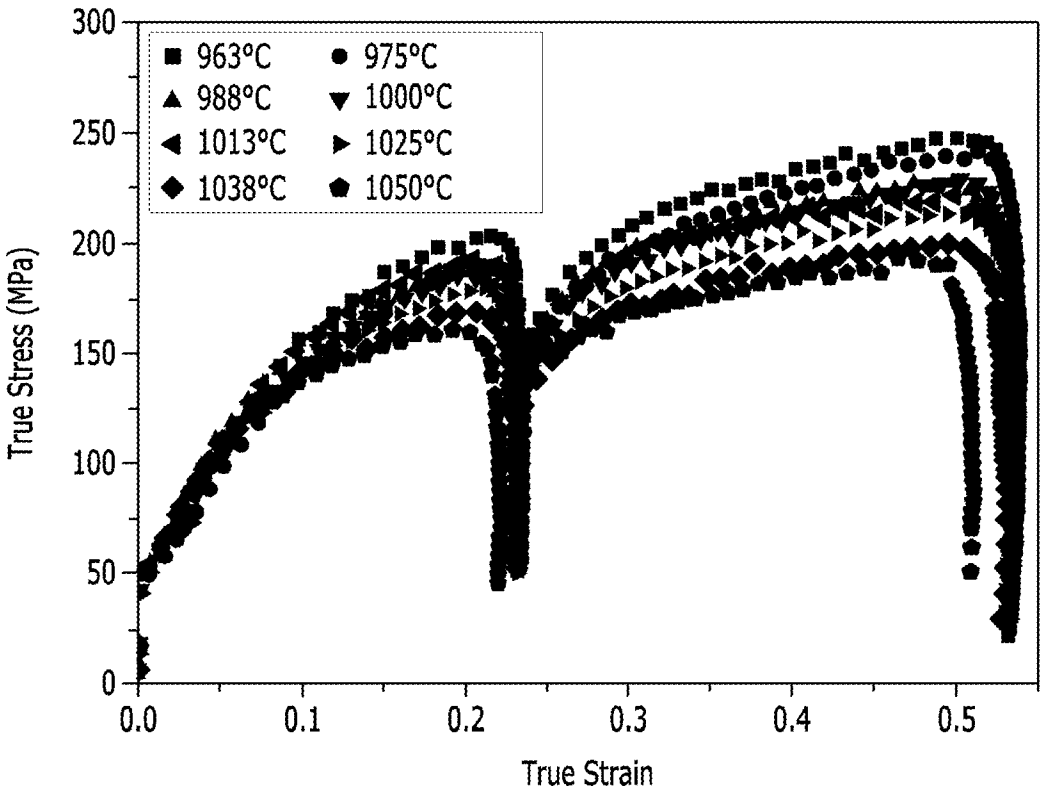
FIGS. 3*a* and 3*b* are graphs showing the result of a high-pressure compression test in the step of deriving a non-recrystallization temperature in Example 1.
Figure 3B:
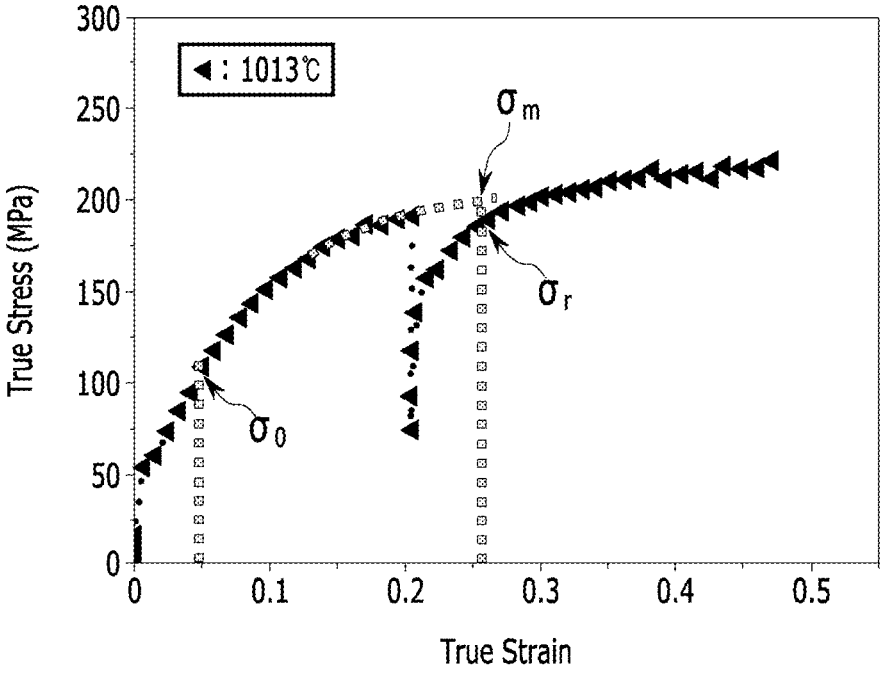

The shape of the specimen was a cylindrical having a diameter of 10 mm and a height of 12 mm, which is a standard commonly used in a high temperature compression test. A Gleeble compression test was performed at a strain rate of 5 $s^{-1}$ at an interval of 12.5° C. from 963° C. to 1050° C., and a high temperature deformation constitutive equation was derived from the true stress—true strain curves obtained from each experiment. In addition, the specimen was heated to a temperature of 1200° C. at a heating rate of 10° C./sec under a high-purity argon atmosphere to prevent oxidation, maintained for 10 minutes, air-quenched, and then subjected to two compression tests at a test temperature, and strain of 20% was applied to the specimen for each compression. The results of high-pressure compression tests are shown in FIGS. 3*a* and 3*b*.

The non-recrystallization temperature derived from the test was 1013° C.

3) Homogenizing Heat Treatment

The cast ingot obtained from step 1) was subjected to homogenizing heat treatment at 1200° C. for 1 hour.

4) Multi-Pass Hot Rolling

A total of 6-pass multi-pass rolling was performed based on the non-recrystallizing temperature of 1013° C. obtained from step 2), resulting in a total reduction ratio of 70%. The hot rolling start temperature was 1120° C., 4-pass hot rolling was performed at a temperature interval of about 27° C. to the non-recrystallization temperature, and 2 pass hot rolling was also performed at a temperature interval of about 27° C. even below the non-recrystallization temperature.

TABLE 2

| | Homogenizing temperature (° C.) | Rolling start temperature (° C.) | Rolling end temperature (° C.) | Initial steel plate thickness (mm) | Final steel plate thickness (mm) | Reduction ratio (%) |
|---|---|---|---|---|---|---|
| Example 1 | 1200 | 1120 | 960 | 30.1 | 9.1 | 70 |

5) Fine Niobium Carbide Precipitation

An austenitic stainless steel containing fine niobium carbide was manufactured by performing a heat treatment on the steel material subjected to step 4) for forming fine niobium carbide at 700° C. for 1 hour and performing air quenching the steel material.

Examples 2 to 9

Austenitic stainless steels containing fine niobium carbide were manufactured by the same manufacturing process as that in Example 1, except that heat treatment in step 5) was performed at 700° C. for 2 hours (Example 2), at 700° C. for 4 hours (Example 3), at 750° C. for 1 hour (Example 4), at 750° C. for 2 hours (Example 5), at 750° C. for 4 hours (Example 6), at 800° C. for 1 hour (Example 7), at 800° C. for 2 hours (Example 8), and at 800° C. for 4 hours (Example 9).

Comparative Example 1

Unlike Example 1, a hot rolling was performed at 1100° C., a solution heat treatment was performed at 1050° C., and then a stabilizing heat treatment was performed at 900° C. for 2 hours to prepare a Type 347 stainless steel containing niobium carbide in the matrix.

The Type 347 stainless steel was a type of stainless steel having a niobium content similar to that of Example 1, among commercially available stainless steel 300 series. The values of the quantitatively analyzed chemical composition are shown in Table 3 below.

TABLE 3

| | Fe | Cr | Ni | C | Mn | Si | Nb | Ti | N |
|---|---|---|---|---|---|---|---|---|---|
| Comparative Example1 | Bal. | 17.25 | 10.22 | 0.025 | 1.68 | 0.40 | 0.28 | — | 0.013 |

Comparative Example 2

Mixed steel material having the same composition as that in Example 1 was used (see Table 1), and unlike Example 1, a hot rolling was performed at 1100° C., a solution heat treatment was performed at 1050° C., and then a stabilizing heat treatment was performed at 900° C. for 2 hours to form niobium carbide in the matrix, thereby manufacturing stainless steel containing niobium carbide.

Experimental Example

Figure 4A:
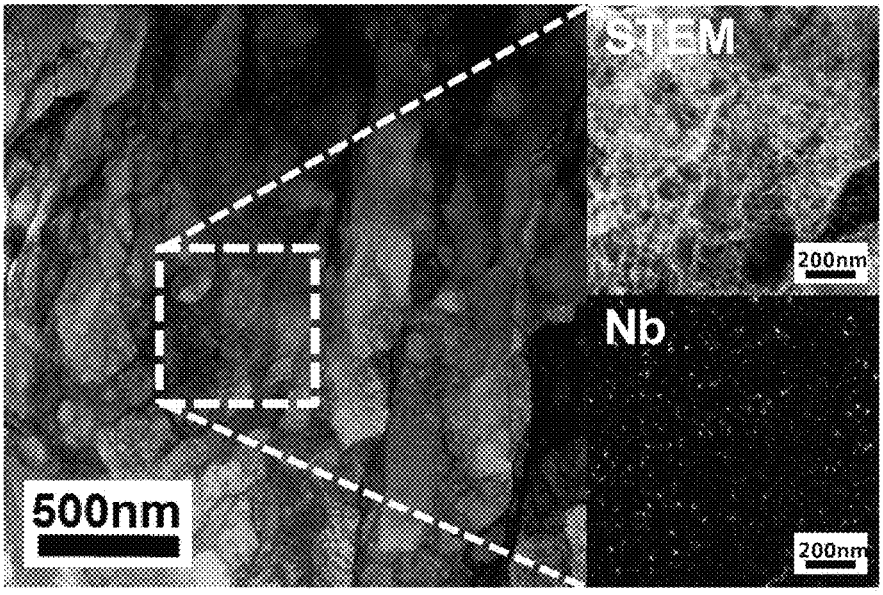
FIGS. 4*a* to 4*c* are transmission electron microscope microstructure photographs of an austenitic stainless steel containing fine niobium carbide according to Example 8.
Figure 4B:
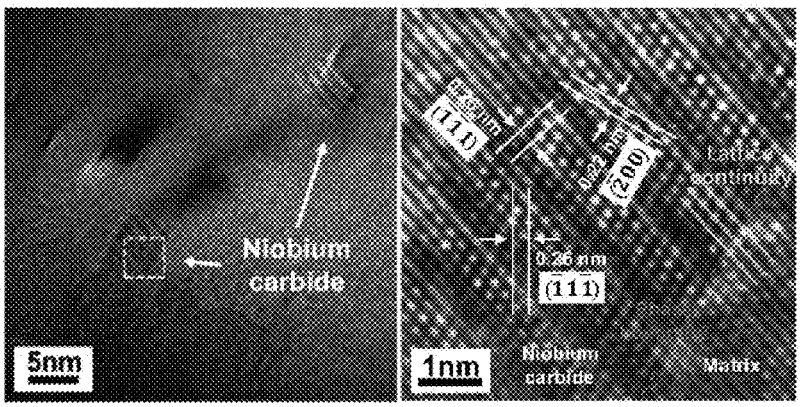
Figure 4C:
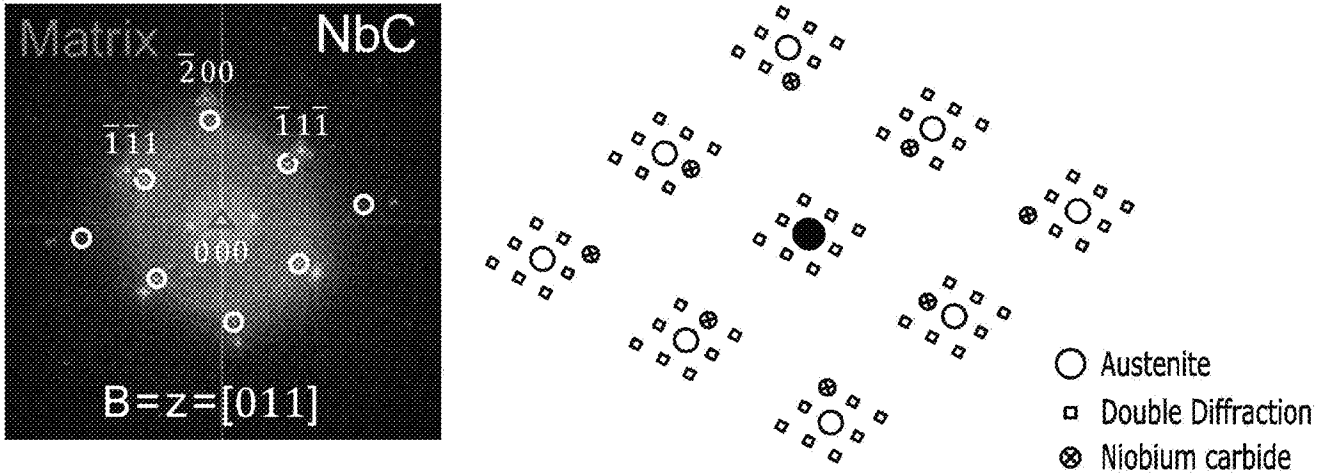
Figure 5A:
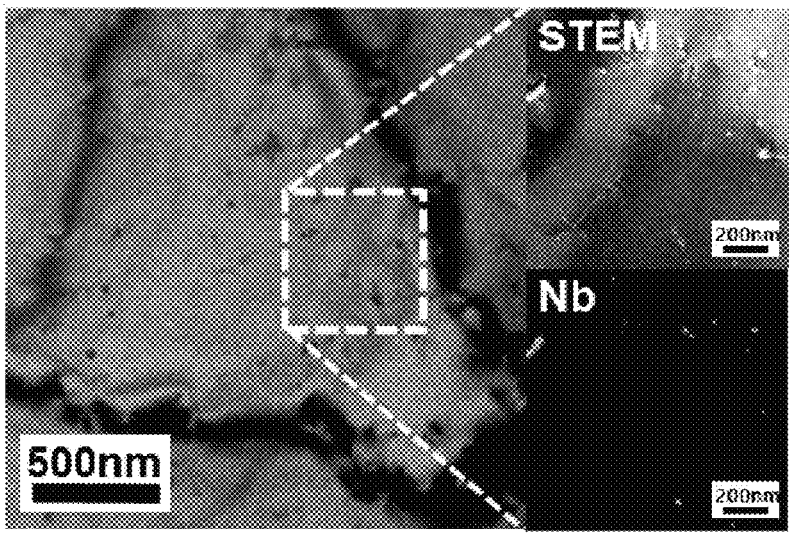
FIG. 5*a* is a transmission electron microscope microstructure photograph of a Type 347 stainless steel containing niobium carbide according to Comparative Example 1.
Figure 5B:
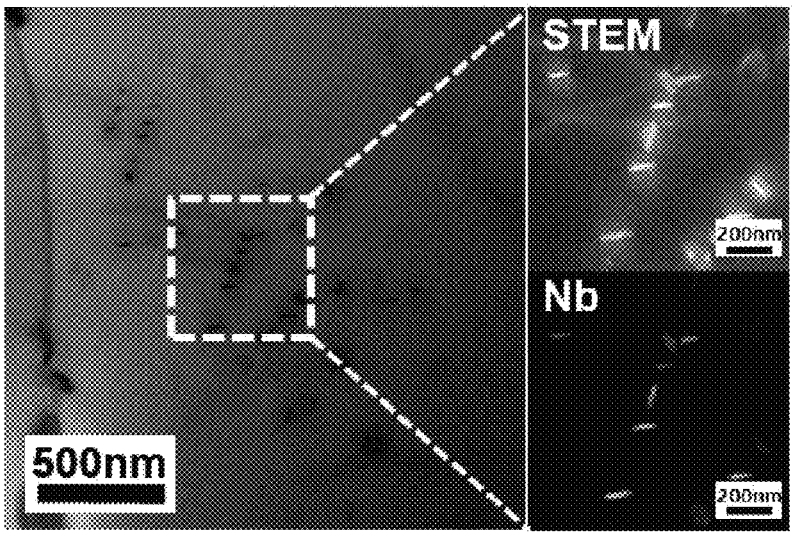
FIG. 5*b* is a transmission electron microscope microstructure photograph of a stainless steel containing niobium carbide according to Comparative Example 2.
Figure 6:
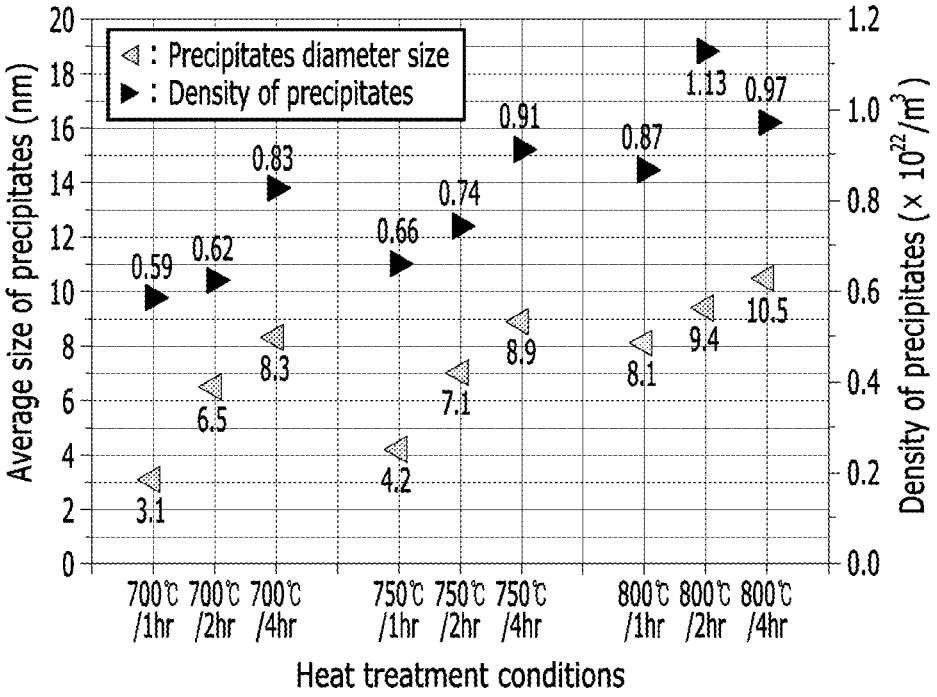
FIG. 6 is a graph showing the results of measuring an average size and density of precipitates depending on heat treatment conditions of an austenitic stainless steel containing fine niobium carbide according to Examples 1 to 9.

Transmission electron microscope microstructure photographs of an austenitic stainless steel containing fine niobium carbide according to Example 8 are shown in FIGS. 4*a* to 4*c*. A transmission electron microscope microstructure photograph of a Type 347 stainless steel containing niobium carbide according to Comparative Example 1 is shown in FIG. 5*a*. A transmission electron microscope microstructure photograph of a stainless steel containing niobium carbide according to Comparative Example 2 is shown in FIG. 5*b*. In addition, the results of measuring the average size and density of precipitates depending on heat treatment conditions of an austenitic stainless steel containing fine niobium carbide according to Examples 1 to 9, including Example 8 are shown in FIG. 6.

Referring to FIGS. 4*a* to 6, in the case of stainless steel according to Example 8, it can be seen that niobium carbide was relatively homogeneously or uniformly distributed in the matrix structure. Here, the number density, the density and the average size of the fine niobium carbide were $5.12\times10^{14}$ #/m$^2$, $1.13\times10^{22}$ #/m$^3$, and 9.4 nm, respectively.

On the other hand, in the case of the stainless steel according to Comparative Examples 1 and 2, it can be seen that niobium carbide was relatively heterogeneously or non-uniformly distributed in the matrix structure, coarsening occurred locally, and the density of niobium carbide precipitate was relatively low. The number density, the density and the average size of the stainless steel according to Comparative Example 1 were $2.29\times10^{13}$ #/m$^2$, $1.10\times10^{20}$ #/m$^3$, and 19.3 nm, respectively. In addition, the number density, the density and the average size of the stainless steel according to Comparative Example 2 were $8.99\times10^{12}$ #/m$^2$, $2.69\times10^{19}$ #/m$^3$, and 66.2 nm, respectively.

Referring again to FIG. 6, it can be seen that in the nano-sized niobium carbide precipitate according to the Examples, the average diameter was in the range of 3.1 nm to 10.5 nm, which is very small compared to the Comparative Examples, and the density was in the range of $0.59\times10^{22}$ #/m$^3$ to $1.13\times10^{22}$ #/m$^3$, which is much higher compared to the Comparative Examples. In the nano-sized niobium carbide precipitate according to the Examples, the average diameter thereof was reduced by about 46% to 84% and the density thereof was increased about 53 to 103 times, as compared with Comparative Example 1.

In the case of Comparative Example 1, it can be seen that titanium nitride was not contained in the stainless steel due to not containing titanium element, the process of forming the matrix structure was not stable, the hot-rolling process was performed at a temperature higher than the recrystallization temperature, and the stabilizing heat treatment was performed at a relatively high temperature of 900° C., such that niobium carbide was coarsened in size and was not uniformly distributed. In addition, in the case of Comparative Example 2, it can be seen that the hot-rolling process was performed at a temperature higher than the recrystallization temperature, and the stabilizing heat treatment was performed at a relatively high temperature of 900° C., such that niobium carbide was coarsened in size and was not uniformly distributed.

On the other hand, in the case of the austenitic stainless steel according to the Examples, the non-recrystallization temperature was derived, the multi-pass hot rolling process of performing not only at a temperature higher than the non-recrystallization temperature but also at a temperature lower than the non-recrystallization temperature was performed, thereby forming a large amount of dislocation in the matrix to appropriately distribute the carbide in the matrix, and then, the stabilizing heat treatment was performed at a temperature (700 to 800° C.) at which niobium carbide is formed, whereby the nano-sized fine niobium carbide may be homogeneously/uniformly precipitated and distributed in the austenitic matrix structure. Therefore, the stainless steel may be remarkably improved in mechanical behavior, may have a high specific strength, may greatly improve the irradiation resistance against neutrons, and may improve weldability.

Hot rolling conditions and the heat treatment conditions for forming the precipitates are appropriately adjusted, a conventional solid solution heat treatment process is omitted, and the continuous multi-step pass hot rolling process is applied. Therefore, manufacturing costs such as the heat treatment costs may be greatly reduced and the productivity may be improved.

In addition, the method of manufacturing the austenitic stainless steel containing fine niobium carbide may also be applied to vanadium, titanium, tantalum and hafnium carbides and various nitrides, in addition to niobium carbide, when precipitates are formed below the melting temperature of the matrix.

While this invention has been described in connection with what is presently considered to be practical exemplary embodiments, it is to be understood that the invention is not limited to the disclosed embodiments. On the contrary, it is intended to cover various modifications and equivalent arrangements included within the spirit and scope of the appended claims.

The invention claimed is:

1. An austenitic stainless steel containing niobium, comprising:

16 to 26 wt. % of chromium (Cr), 8 to 22 wt. % of nickel (Ni), 0.02 to 0.1 wt. % of carbon (C), 0.2 to 1 wt. % of niobium (Nb), 0.015 to 0.025 wt. % of titanium (Ti), 0.004 to 0.01 wt. % of nitrogen (N), and 0.5 to 2 wt. % of manganese (Mn), wherein the austenitic stainless steel containing niobium has an austenitic matrix structure, a niobium carbide (NbC) and a titanium nitride (TiN) are precipitated in the austenitic matrix structure, the niobium carbide is uniformly dispersed in the austenitic matrix structure, and an average size of the niobium carbide is 11 nm or less.

2. The austenitic stainless steel containing niobium of claim 1, wherein:

a content of the titanium is 0.018 to 0.022 wt. % and a content of the nitrogen is 0.005 to 0.008 wt. %.

3. The austenitic stainless steel containing niobium of claim 1, wherein:

the number density of the niobium carbide is $10^{14}$ to $10^{15}$ #/$m^2$ in the austenitic matrix structure.

4. The austenitic stainless steel containing niobium of claim 3, wherein:

the density of the niobium carbide is $5\times10^{21}$ to $5\times10^{22}$ #/$m^3$ in the austenitic matrix structure.

5. The austenitic stainless steel containing niobium of claim 1, further comprising:

0.5 wt. % or less of silicon (Si), 0.02 wt. % or less of phosphorus (P), and 0.01 wt. % or less of sulfur (S).

* * * * *